United States Patent [19]

Hsiao

[11] 4,391,216

[45] Jul. 5, 1983

[54] FEED MECHANISM FOR SEWING MACHINES

[75] Inventor: James C. Hsiao, Morton Grove, Ill.

[73] Assignee: Union Special Corporation, Chicago, Ill.

[21] Appl. No.: 204,410

[22] Filed: Nov. 6, 1980

[51] Int. Cl.[3] ..... D05B 27/02; D05B 27/22

[52] U.S. Cl. ..... 112/316; 112/323

[58] Field of Search ..... 112/315, 316, 317, 323

[56] References Cited

U.S. PATENT DOCUMENTS

| | | | |
|---|---|---|---|
| 1,118,271 | 11/1914 | Diehl et al. | 112/317 |
| 1,404,357 | 1/1922 | Flanagan | 112/316 |
| 2,035,508 | 3/1936 | Sauer et al. | 112/323 |
| 2,058,837 | 10/1936 | Smith | 112/316 |
| 2,172,559 | 9/1939 | Kaier | 112/316 |
| 2,258,487 | 10/1941 | Garwin et al. | 112/316 |
| 2,430,207 | 11/1947 | Best | 112/316 |
| 2,672,112 | 3/1954 | Hale | 112/315 |
| 2,794,408 | 6/1957 | Parry | 112/316 |
| 3,011,462 | 12/1961 | Ritter et al. | 112/315 |
| 3,012,531 | 12/1961 | Engel | 112/316 |
| 3,611,817 | 10/1971 | Smith et al. | 112/313 |
| 4,140,070 | 2/1979 | Travaglini | 112/313 |
| 4,276,841 | 7/1981 | Weisz | 112/317 |
| 4,328,759 | 5/1982 | Astrupgaard et al. | 112/316 |

*Primary Examiner*—Wm. Carter Reynolds

*Attorney, Agent, or Firm*—John W. Harbst; John A. Schaerli

[57] ABSTRACT

This disclosure relates to a four motion feed mechanism for sewing machines that is adapted to advance a workpiece past the stitch forming point of the machine. Orbital movement is imparted to the feed dog by a drive mechanism including first and second linkage assemblies driven off a common eccentric arranged on the sewing machine bed shaft. A feed regulating assembly including a single feed regulator control knob is operatively associated with one of the linkage assemblies to selectively pre-set the stitch length of the machine.

27 Claims, 10 Drawing Figures

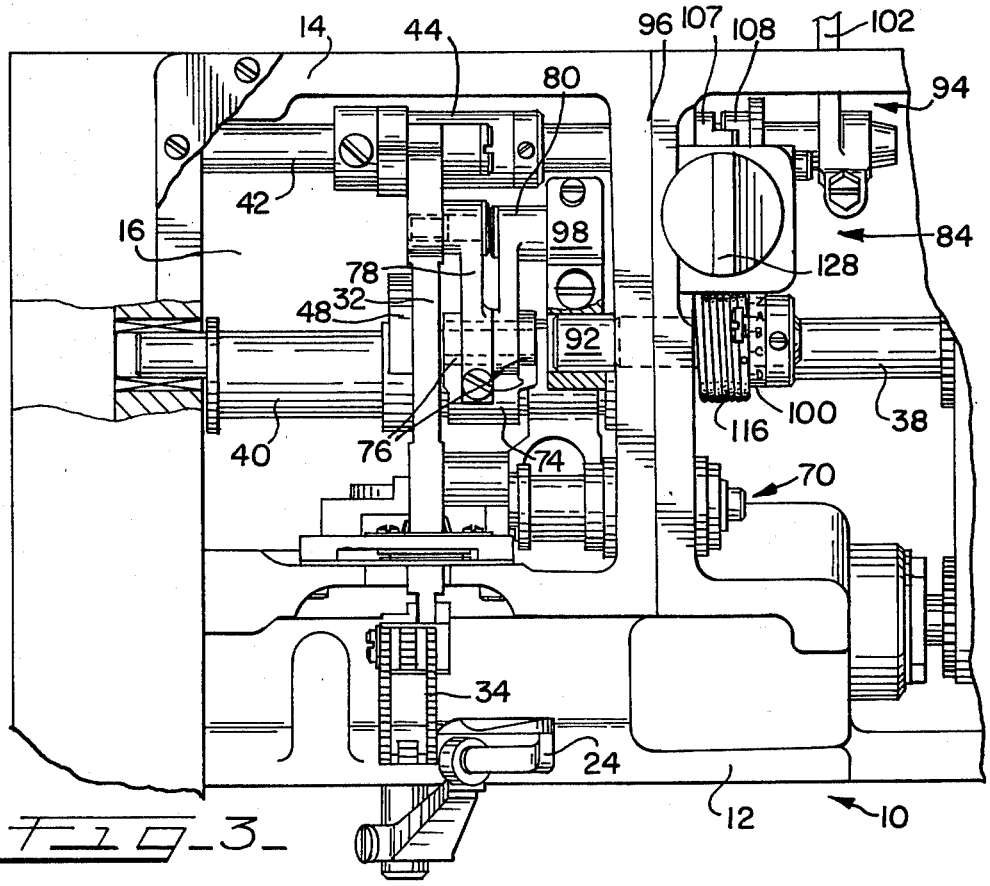
FIG. 3
FIG. 4
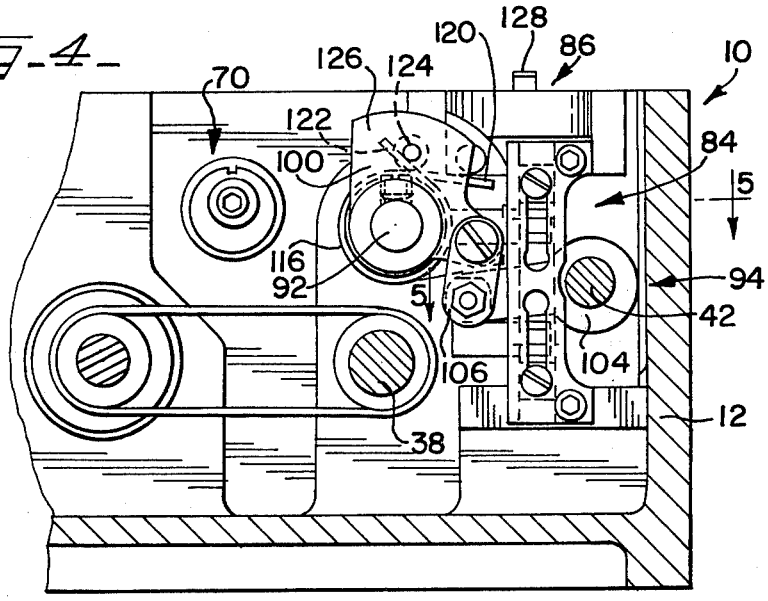

FEED MECHANISM FOR SEWING MACHINES

FIELD OF THE INVENTION

The present invention relates to sewing machines and, more particularly, to a feed mechanism for sewing machines.

BACKGROUND OF THE INVENTION

As is understood, four motion feed mechanisms (also known as drop feed mechanisms) have been known for a number of years. With this particular type mechanism, movement of the feed dog is comprised of two components; namely, a height wise movement known as feed "lift" and a horizontal movement known as feed "advance". As is well known, the "advance" motion of the feed dogs determine the stitch length. In an industry such as sewing, where it is necessary to handle varying workpieces, it has been heretofore considered desirable to provide a sewing machine with a feed mechanism which is capable of accomplishing varying stitch lengths as well as develop a feed dog movement in a plurality of directions, e.g. forward and reverse feed relative to the machine needle.

Additionally, some of these machines are provided with means for adjusting the stitch length of the machine. In these machines, however, adjustment of the forward feed stitch length simultaneously and equally reflects adjustment of the stitch length in the reverse feed direction. That is, the art fails to show independent adjustment of the stitch lengths in either feed direction by using a single control knob.

SUMMARY OF THE INVENTION

In view of the above, and in accordance with the present invention, there is provided a feed mechanism that is arranged in the machine frame for incrementally moving a workpiece past the sewing instrumentalities of the machine in a plurality of directions. The feed mechanism of the present invention includes feed bar means and feed dog means carried thereby. A first linkage assembly for moving the feed bar means in a vertical direction and a second linkage assembly for simultaneously moving the feed bar means in a horizontal feed direction whereby moving the feed dog means in a generally orbital path. Both the first and second linkage assemblies derive their motion from a common eccentric fixedly secured on a shaft revolvably mounted in the frame of the machine.

In the presently preferred embodiment, the second linkage assembly includes a pitman, one end of which embraces the eccentric, an arm adapted to connect the free end of the pitman to the feed bar means of the machine, and an anchor link. The anchor link is pivoted at one end about a fulcrum, the operative position of which regulates the stitch length and direction developed at the feed dog means. The fulcrumed position of the anchor link may be influenced by a shiftable lever assembly operable at the will of the operator.

To control the stitch length, and confine the movement of the feed dog means within predetermined limits, the present invention is provided with a stitch regulatory assembly. The regulatory assembly includes aligned first and second limit stop assemblies and a single, operator influenced control member capable of independently setting the limit stops to any desired position. The above described lever or linkage assembly employed for shifting the fulcrumed position of the anchor link includes a projecting member disposed intermediate the first and second limit stops. Thus, the perimeter of feed dog movement is determined by the extent of freedom of movement of the projecting member between the limit stops. In the preferred embodiment, the projecting member and, ultimately, the fulcrumed position of the second motion transfer assembly is continually biased into one extreme position defining a maximum forward feed. This position may be modulated, however, by actuating the control element thus achieving various linear positions for the limit stop and also modifying the disposition of the fulcrum point, whereby changing the stitch length. At will, this single control element may also be employed to independently modify or modulate the position of the other limit stop defining the other extreme position for the fulcrumed anchor link. Another series of stop means are also provided for limiting the movement of the first and second limit stops within predetermined limits. Suitable brake members are also provided to inhibit movement of the first and second limit stops during the normal working of the machine.

In line with the above, it is a primary object of this invention to provide a simple and effective feed mechanism that is capable of advancing a workpiece past the stitch forming instrumentalities of the machine.

Another object of the invention is the provision of a feed mechanism, the orbital movement of which is the product of two independent linkage systems that are actuated by a single crank.

Another object of the invention is the provision of a feed mechanism having means, operable at the will of the operator, for governing the magnitude and direction of work feeding movements of the work feeding element.

A distinct advantage of the present invention over the known prior art is the provision of a feed regulatory assembly having a single, operator influenced control member that is capable of independently adjusting both the forward and reverse feed limit stops of the machine.

Still another object of the present invention is to provide a regulatable feed mechanism for sewing machines in which the stitch length of the machine may be selectively adjusted by the operator to meet various conditions of operation without correspondingly affecting the feed lift of the mechanism.

BRIEF DESCRIPTION OF THE DRAWINGS

Having in mind the above objects and other attendant advantages that would be evident from an understanding of this disclosure, the invention comprises the devices, combinations, and arrangements of parts as illustrated in the presently preferred embodiment of the invention which is hereinafter set forth in detail to enable those skilled in the art to readily understand the functions, operation, construction, and advantages of it when read in conjunction with the accompanying drawings in which;

FIG. 3 represents a top plan view taken along the Line 3—3 of FIG. 1;

FIG. 4 represents a detailed end view showing the adjustable regulatory assemblage;

DETAILED DESCRIPTION OF THE PREFERRED EMBODIMENT

Figure 1:
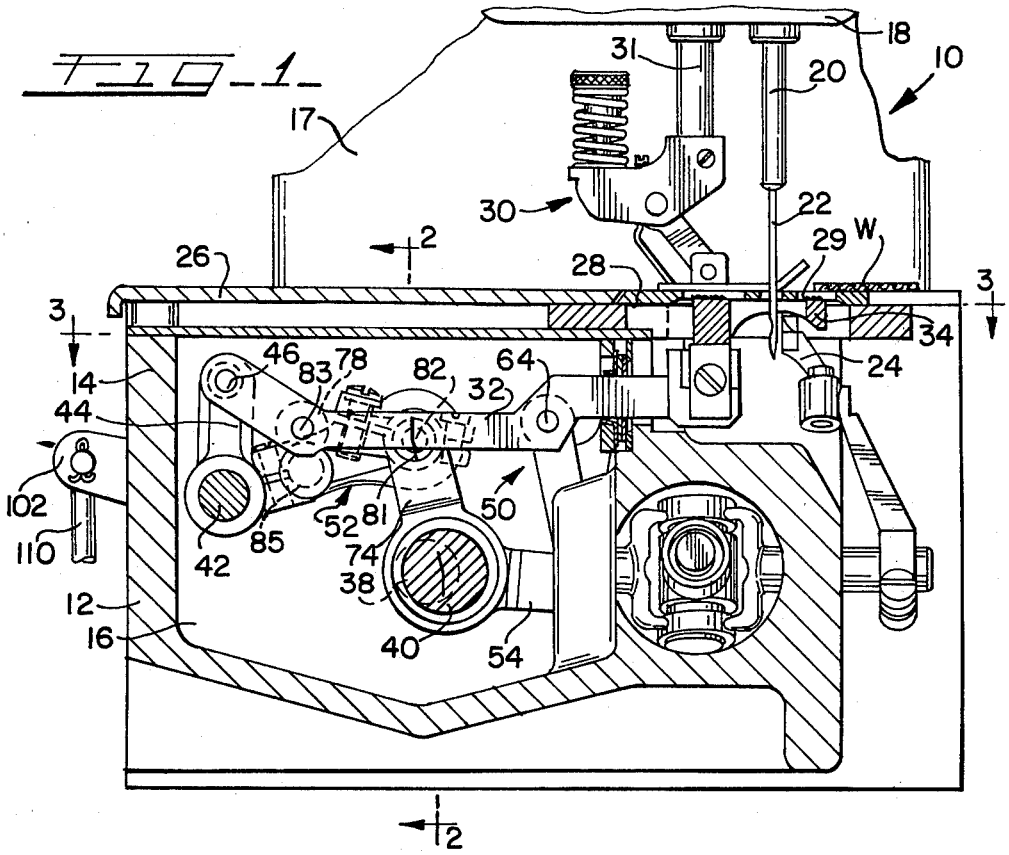
FIG. 1 represents a partial end elevational view of a sewing machine with a vertical section taken substantially through the work support and a portion of the frame broken away so as to illustrate a preferred embodiment of the present invention.

Referring now in more detail to the drawings, in which like reference numerals indicate like parts throughout the several views, only so much of a sewing machine is shown as is deemed necessary to illustrate the application and mode of operation of a presently preferred embodiment of the invention. The improved feed mechanism hereunder consideration is shown as applied to a sewing machine having a housing, generally designated as 10, comprising a bed or frame 12 from which extends a hollow arm 14, having a chamber means 16 formed at one end thereof. Rising from and detachably secured to the other end of the bed or base, is the standard 17 which supports a bracket arm (not shown) terminating in a hollow sewing head 18 which overhangs the free end of the arm 14. Mounted for endwise reciprocation in the head is a needle bar 20 which carries, at its lower end, thread carrying needle means 22. The needle means 22 is adapted to cooperate with other suitable stitch forming instrumentalities, for example, a loop taker means 24 as is well known in the art, to form stitches at a stitching point. During operation of the machine, the workpiece W (FIG. 1) being sewn is moved across a work support means 26 and is held against the throat plate 28 by a presser foot assembly 30 carried on the lower end of a presser bar 31. As well known in the art, the presser bar 31 may be spring biased downwardly and is journaled for endwise sliding movement in the head 18.

The work is adapted to be fed past the stitching instrumentalities by means of a four motion feed mechanism. The mechanism includes an elongated feed bar means 32, the distal or forward end of which extends beyond the chamber 16 and has secured thereto suitable material engaging gripper or feed dog means 34 that are arranged in an area spaced from said chamber. It will be understood that the feed dog means 34 intermittently rises above the level of the top surface of the throat plate 28 through suitable openings 29 provided therein so as to cooperate with said presser foot assembly 30 in advancing the workpiece in incremental amounts in translation over said work support means and past the needle in the intervals when the latter is disengaged from the work. The feed bar means and feed dog means carried thereby are given the usual "feed" and "return" movements and "rising" and "falling" movements through mechanism subsequently described.

Longitudinally mounted in the frame beneath the work support is a revolvable drive shaft 38, one end of which may be formed with an eccentric or rotary actuator 40. At a ratio of one to one, the shaft 38 drives, through suitable transmission means well known in the art, the needle drive shaft (not shown) which is revolvably mounted in the head such that the needle and feed mechanism move in timed relation relative to one another. Also received in the bed of the machine is a rockshaft 42 which is arranged parallel to the main shaft 38. Arranged on the rockshaft for free pivotal rotation is a rocker arm 44 whose upper extremity is articulated as at 46 to the rear of the feed bar means 32 whereby supporting same.

The drive mechanism of the present invention includes a series of connections for operatively associating the feed bar means 32 with the eccentric or crank 40. The subject drive mechanism is effective to impart movement to the feed bar means in mutually perpendicular or orthogonal directions. One direction being transversly across said bed to provide work advancing and return movements to said feed dog means. The other direction being toward or away from said work support so as to "lift" the feed dog means to a position above the work support during the work advancing movement and to lower the feed dog means to a position below the work support during the return movement. In one embodiment, the drive mechanism for imparting movement to the feed bar includes first and second independent linkage assemblies, generally designated 50 and 52, respectively, whose driving directions are orthogonal to each other, but which employ the eccentric 40 as a common crank for transmitting motion to the feed bar means. In that the motion transmitting assemblies 50 and 52 utilize a common crank, the resulting vector sum of the othogonal forces applied to the eccentric 40, and thus to the shaft 38, can be readily balanced by a counterweight means 48 suitably fixed on the shaft 38. Another inherent advantage of the present invention is that the independence of the linkage assemblies allows one mechanism or assembly to be adjusted without affecting the performance of the other. The significance of this feature may readily be appreciated to one skilled in the art.

In its presently preferred construction, the first linkage assembly 50 includes a pitman 54 whose one end embraces the eccentric 40 such that rotation of shaft 38 results in reciprocation of the pitman. At its free end, the pitman is connected to two links 60 and 62, each of whose end is connected to the free end of the pitman. The other end of link 60 is articulated as at point 64 to the feed bar means 32. The second link 62 extends from its pivotal connection with the pitman and is connected to a feed lift regulatory assemblage generally identified by numeral 70 (FIG. 3). A detailed description of the feed lift regulatory assembly may be found in my U.S. application Ser. No. 087,906 filed Oct. 24, 1979, now U.S. Pat. No. 4,295,434.

Figure 9:
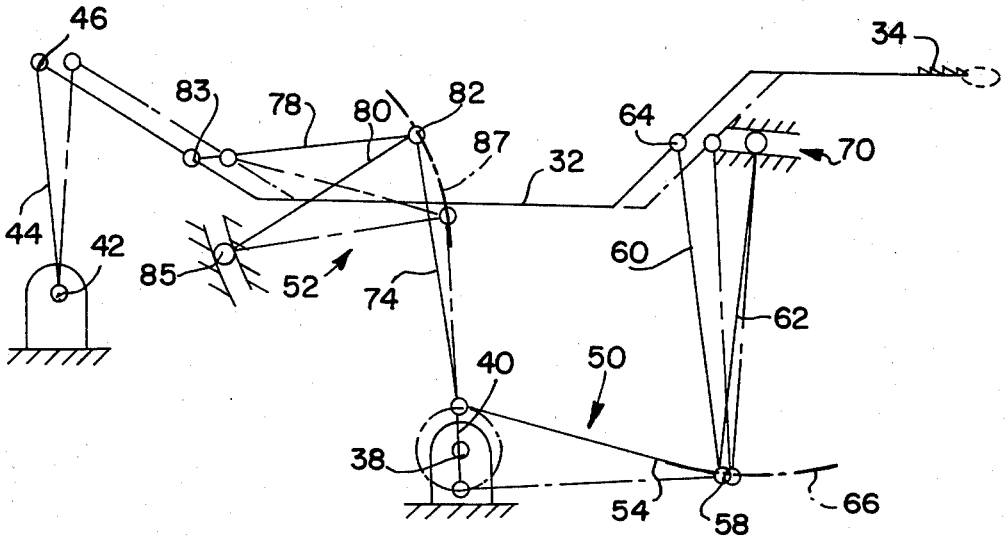
FIGS. 9 and 10 are schematic representations of the improved work feed mechanism in different operative positions.

As may be best viewed in FIG. 9, rotation of shaft 38 is converted into oscillatory motion by the combination of the eccentric 40 and the pitman 54. The point 58 whereat the pitman is pivotally connected to the links 60 and 62 is constrained to move in the arc of a circle, indicated at 66, owing to the positive guiding by the link 62 which, as mentioned, has one end fulcrumed about the feed lift regulatory assembly 70. As may be appreciated by one skilled in the art of kinematics, the movement of pitman 54 causes the link 60, through the constrained movement of link 62 and pitman 54, to impart feed left motion to the feed bar whereby moving the feed dog means in the vertical direction.

Figure 10:
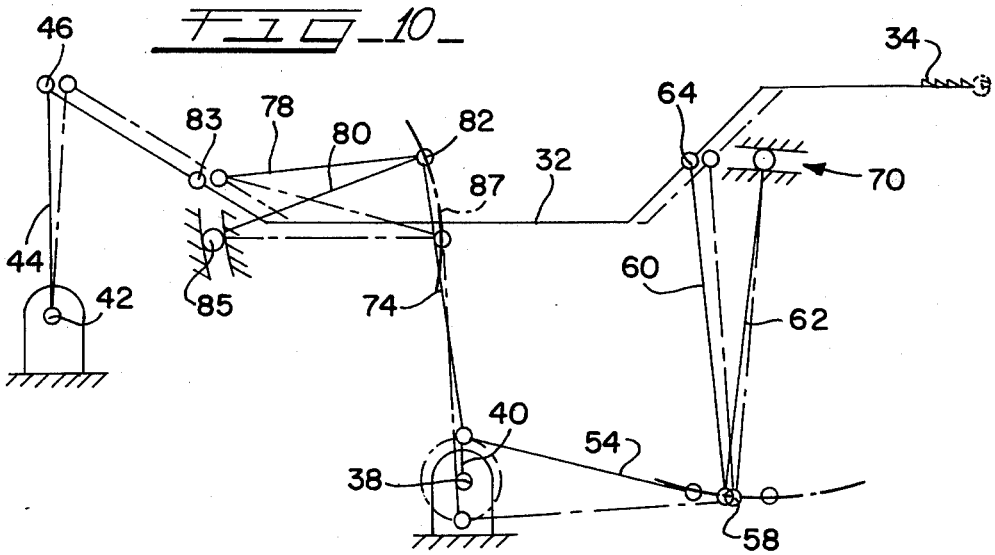

During operation of the machine, the vertical movement or "lift" that is imparted to the feed bar means and feed dog means through the combined action of the eccentric 40 and the first linkage assembly 50 is superimposed on the horizontal or longitudinal movements produced by the combined actions of the common eccentric 40 and the second linkage assembly 52 so that the feed dog means performs an orbital motion in a vertical plane. The second linkage assembly 52 is similar to the first in that it includes a pitman 74 one end of which embraces the eccentric 40. At its free end, the pitman 74 is provided with tines 76 serving to secure a pair of links 78 and 80, each of whose effective length is equal to that of the other. The links 78 and 80 are pivoted about a common point designated 82. As is apparent from the drawings, the links 78 and 80 serve to transmit motion between the crank and the feed bar and are pivotally mounted upon a pin or stub shaft 81 which spans the void between the tines 76 of the pitman to provide the common pivot point 82 for one end of the links 78 and 80. The opposite end of the link or arm 78 is articulated to the feed bar means 32 at a point designated generally as 83. The opposite end of link 80 is pivotally anchored or fulcrumed as at 85. It will be understood, the fulcrum 85 is effectively disposed intermediate the rotary crank 40 and the feed bar 32. As such, the fulcrum 85 allows longitudinal or horizontal movement to be translated between the eccentric 40 and the feed bar 32 through the subject linkage assembly. The fulcrum 85 is movable from a change point position (zero stitch length) in opposite directions to regulate the stitch length of the feed dog. That is, when the fulcrum 85 is located at its center or change point position, the straight line approximation traced by the motion of connection point 82 (arc 87) is generally perpendicular to the work support means. Accordingly, the horizontal displacement (stitch length) of the feed dog is relatively small. When the fulcrum 85 is positioned other than at its center position, the straight line approximation traced by the displacement of the connection point 82 is displaced at an angle to the work support and, depending on the fulcrum placement, various degrees of horizontal movement will be imparted to the feed dog means. A comparison of FIGS. 9 and 10 illustrates the operative effect of fulcrum point displacement or modulation. As shown in phantom lines at the distal end of the feed dog means 34, modulation of the fulcrum point 85 toward or away from its change point location results in a change in the horizontal displacement of the feed dog and, thus, stitch length.

When considering the kinematics of the second linkage assembly 52, it is evident that the effect of rotating the crank 40 is that movement will be imparted to the pitman 74. As schematically represented in FIGS. 9 and 10, the movement of the pitman 74 is controlled or effected by the limited arcuate movement of the anchor link 80 such that the point 82 at which they are connected is constrained to move over the arc 87. The arcuate movement of the anchor link 80 and its connection with the pitman thereby defines the movement of link 78 at point 82 which, as mentioned, is articulated to the pitman about the common connection point 82 and to the feed bar and thus, the feed dog. The movement of the pitman causes the link 78 through the constrained movement of the anchor link 80 and the pitman 74, to impart a transverse feed or longitudinal movement to the feed dog means which is generally perpendicular to the feed lift motion produced by the other motion transmitting assembly. It is important to note, however, that the longitudinal or horizontal characteristics of the feed path depend on the location or disposition of the fulcrum 85. That is, selective location of the fulcrum point 85 to one side or the other of the change point, whereat points 83 and 85 may be made to substantially coincide, will determine the direction of movement of the feed dog as will as the length of feed dog movement and thereby length of stitch.

As was mentioned above, in the design of a material feeder mechanism, it is most desirous to provide means for adjusting the stitch length so as to aid the operator and add versatility to the general performance of the machine. To this end, and in order that the stitch length and feeding or indexing direction of the feed dog may be varied, at will, a new and unique stitch length regulatory mechanism, generally designated 84, is provided. As subsequently described in detail, the regulatory means 84 is operatively associated with and effective to influence the disposition of the fulcrum point 85. Through its association with the fulcrum 85, the stitch length regulatory means 84 is effective to adjust the operative effect of crank 40 whereby achieving the functional equivalent of various stitch length cams or eccentrics commonly used in other commercial machines. For purposes of this description, suffice it to say that the operative radius of the crank 40 is that which results from modification of the position of the fulcrum and which, in a machine requiring various stitch length cams, would normally be effective to impart the observed magnitude of movement to the feed bar means; assuming that the fixed lengths of the links comprising the linkage assembly remain the same. Furthermore, the feed regulatory assemblage 84 is effective to obtain a smooth and rapid shifting of the location of the fulcrum 85 thereby controlling the "throw" or movement of link 78 and, hence, the stitch length of the machine.

In one presently preferred embodiment, the feed regulatory means 84 is an assemblage of devices including a single, manually operable adjustment element 86 having conjointly arranged first and second adjustable limit stops 88, 90 arranged thereon, a feed regulatory shaft 92, and a fulcrumed linkage assembly 94 which the operator may, at will, influence to affect a change in the stitch length or direction developed at the feed dog means 34. The feed regulatory shaft 92 is journaled for rotation in a transverse rib 96 of the bed about an axis extending parallel to the main shaft 38. Shiftably arranged on one side of the rib is lever 98 that may be carried adjacent one end of shaft 92. The lever 98 is provided at its free end with a fulcrum pin that acts as the fulcrum 85 for the anchor link 80 of the second motion transmitting assembly 52. Also connected to control shaft 92, although arranged on the opposite side of rib 96, is a bell crank lever 100. The fulcrumed linkage assembly is connected to the lever 100 and is adapted to impart selective turning movements to the control shaft 92. It will be understood that a change in the orientation or position of the control shaft modifies the disposition of the pivot or fulcrum 85 relative to the change point whereby altering the output motion of the second motion transmitting assembly 52 and, hence, the to and fro movement of the feed dog.

In the preferred embodiment, the fulcrumed linkage assembly 94 includes first and second lever means 102 and 104, respectivelly, and a connecting link 106. The lever 102 is fixed to the rocker shaft 42 and the second lever is rotatable with the shaft through suitable interengaging members 107 and 108. The lever 102 may be interconnected, by means of a rod 110, to any suitable manually operable device of the knee or foot pedal type (not shown) that serves to displace, at the will of the operator, the fulcrumed linkage assembly whereby modulating the disposition of the fulcrum 85. The free end of the fulcrumed linkage assembly, and more particularly, the free end of lever 104 is connected to one leg 112 of the bell crank lever 100 by means of the connecting link 106. Adapted for movement with the linkage assembly 94 is a feed regulator block or abutment means 114.

Figure 2:
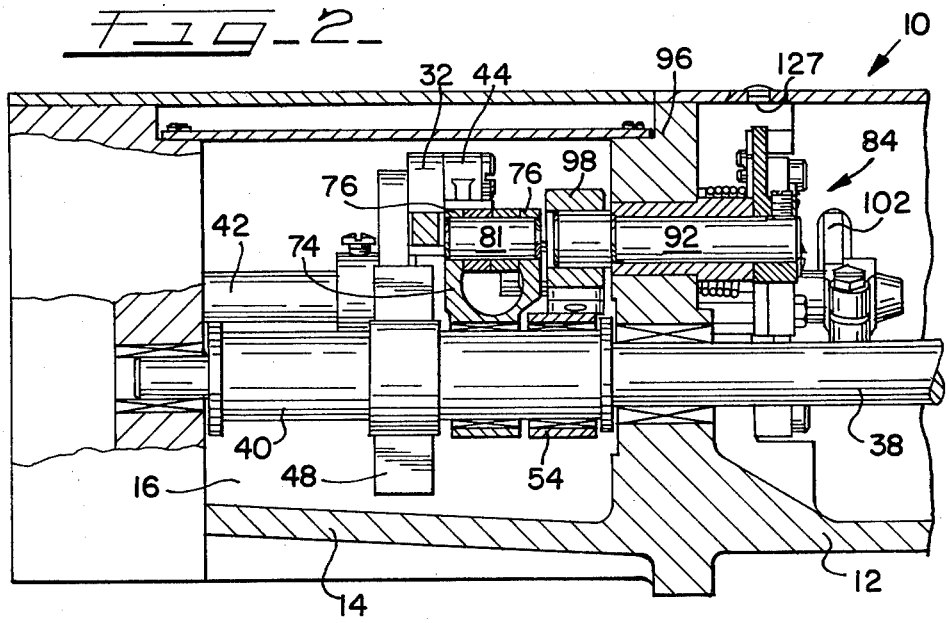
FIG. 2 represents a partial front sectional view taken substantially along the Line 2—2 of FIG. 1.

Movement of the block means is limited by means of a pair of limit assemblies or stop members 88 and 90 disposed on opposite sides of the block means for limiting the movement thereof and, thus, limiting the movement of the fulcrum 85 within confined or predetermined limits. A resilient member 116, preferably a torsion spring, may be arranged about the longitudinal axis of the control shaft 92, with one arm 120 bearing against the frame and the other arm 122 impinging against a projection or screw 124 on the other leg 129 of the bell crank lever 100. This spring serves to continually urge the block means 114 into engagement with one of said limit assemblies and serves to return said block means into a preset position, each time the operator actuates the manually operable device. In the preferred device, the spring is effective to maintain the linkage assembly and, thus, the fulcrumed point 85 in a position defining a set maximum forward stitch length. It will be appreciated, however, that with a minor design change and with the limit assemblies properly adjusted, the system could be adapted such that the fulcrum point is maintained in a position defining a set minimum forward stitch length. By this construction, and with the embodiment shown, operation of the manually actuated device would be effective, if desired, to rapidly shift the fulcrumed position of the second linkage assembly and, thus, modulate the stitch length from maximum to minimum present limits. With either arrangement, the extremity of the leg 129 of the lever 100 is provided with indicia (FIGS. 3 and 8) which when viewed through a suitable aperture 127 in the work support plate (FIG. 2) denotes the present stitch length and direction of the work feed mechanism.

Figure 8:
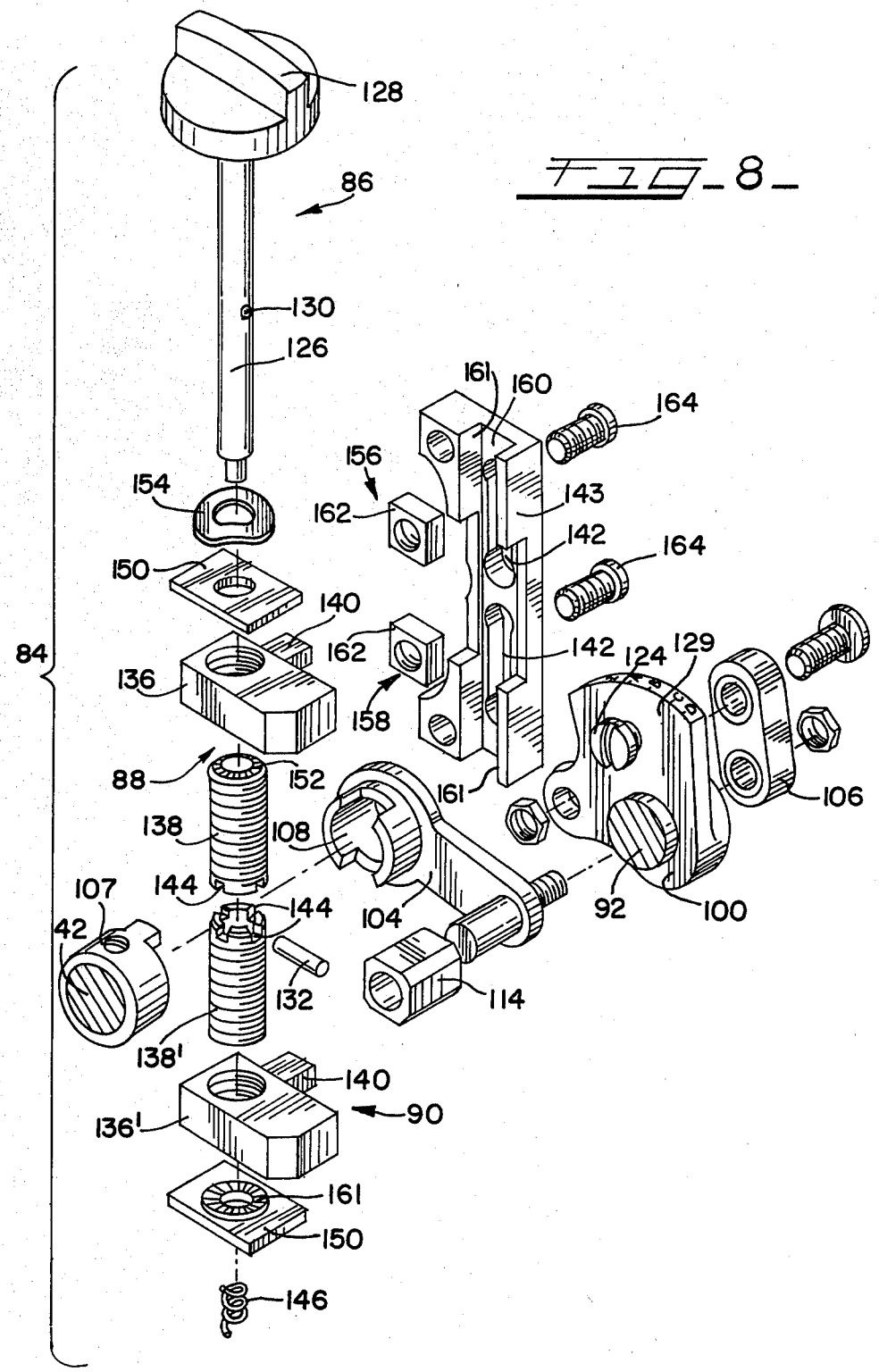
FIG. 8 represents an exploded fragmentary perspective view of the stitch regulatory assemblage means forming a part of the present invention.

The means for independently adjusting the stitch length control mechanism of the invention is shown in exploded perspective in FIG. 8. The control member or element 86 is provided with a depending shaft or rod 126 that is mounted rotatably in the frame of the machine. The control member or element is also given a handle element 128 for convenient manipulation. The element including its handle element 128, is situated, however, such that it does not protrude in a manner interfering with the profile of the machine nor with the advancement of the workpiece over the work support.

Figure 6:
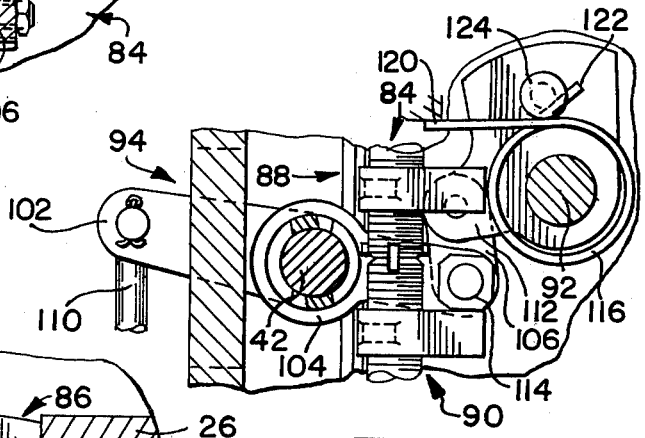
FIG. 6 represents a front elevational view taken along Line 6—6 of FIG. 5.

Intermediate its ends, the shaft 126 is provided with a transverse aperture 130 into which a pin 132 is to be fitted for purposes described hereinafter. Coaxially arranged on the shaft 126 are the aligned first and second limit stop assemblies 88 and 90. In the embodiment shown, the limit assembly 88 is capable of serving a dual function. When the limit assembly 88 is adjusted to allow shifting of the fulcrum to one side of the change point, it serves to limit the stitch length in the reverse feed direction. In the alternative, the limit assembly 98 may be adjusted to the opposite side of the fulcrum's change point whereat it serves to define the minimum obtainable stitch length in the forward feed position. The limit stop assemblies include a pair of interengaging control elements which are telescopically arranged on the shaft 126. More particularly, the first limit stop means 88 includes a linearly movable mechanical stop or nut 136 that is engageable with a threaded member 138, the latter being shaped to fit slideably over the shaft 126. Similarly, the second limit stop means includes a linearly movable mechanical stop or nut 136' that is engagable with a threaded member 138'. Each of the mechanical stops are constrained from rotational movement by means of a projection or finger 140 that extends and is accomodated in a guideway 142 provided by a slotted guide member 143. The abutting ends of the threaded members 138 and 138' are provided with radially disposed slots 144 dimensioned to cooperate with pin 132. As best illustrated in FIG. 6, in their presently preferred assembled arrangement, the threaded members 138 and 138' are held or constrained from endwise movement by the machine frame 12 acting with or through brake means 150 and have the shaft 126 coaxially extending therethrough. It should be appreciated, however, that alternative methods and means for supporting the threaded members in a similar manner may be provided without deterring from the spirit and broad scope of the appended claims. The pin 132 on rod 126 is entrapped between the extremities of the slots 144 and provides means whereby the selector dial may be independently connected with either of the limit stops 88 or 90 so as to linearly adjust same. A spring 146 seated in the bed 12 is provided for continuously biasing the selector knob or dial 86 such that the pin 132 only engages one of the threaded members at any given time. Sufficient depression of the adjustable element will disengage the pin 132 from engagement with one adjustment member and result in engagement of the pin with the other member. The selector or actuating element, therefore, may act independently upon either of the stop limit assemblies to draw them together or separate them as required for a particular operation.

Each of the limit assemblies is provided with a brake means 150 adapted to inhibit movement thereof. In the preferred embodiment, the brake means 150 are constrained by the bed 12 against turning movement with the rod. The ends of the threaded members 138 and 138' are finely serrated, grooved, or otherwise treated as at 152. That portion of the brake member 150 engaging the threaded member is equally treated as for example by a series of fine serrations on the upstruck surface 161 of member 150. Thus, the generally stationary position maintained by the brake retards unwarranted relative motion between the rotatable threaded member and its associated stationary brake. A resilient member 154, such as a spring washer, may be arranged to cause the brake to impinge against the threaded member whereby unwarranted movement of either limit assembly from its adjusted position is inhibited.

Figure 5:
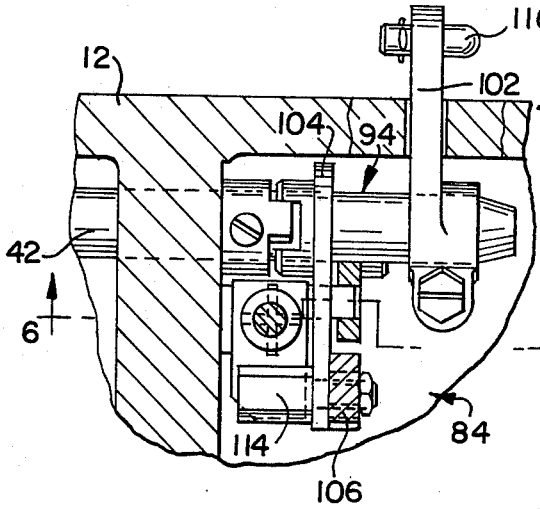
FIG. 5 represents a partial top sectional plan view taken along the Line 5—5 of FIG. 4.
Figure 7:
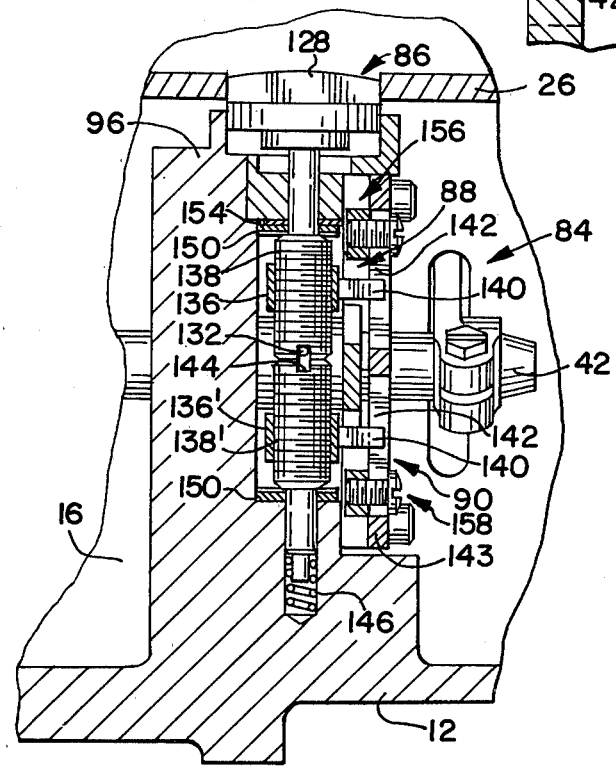
FIG. 7 represents a fragmentary end view showing a part of the machine.

The feed regulating means of the present invention is also provided with first and second stop means 156 and 158 adapted to confine the displacement of said limit assemblies 88, 90 within predetermined limits. One of the stops is positioned to limit movement of the limit means 88 and the other stop restricts the linear displacement of the other limit means. Since both stops 156 and 158 and associated structure may be substantially the same, the stop 156 will be described as representative in connection with FIGS. 6 and 8. As shown, the slotted guide plate or member 143 is formed with an elongated slideway 160 having side edges 161 to slidably accomodate slide member 162 which serves to act as a mechanical stop. The mechanical stop 162 may be adjustably secured in any desired linear position by means of a screw 164 which extends through the guideway 142. In this manner, the stop means 156, 158 may be preset at any desired location along the slideway 160. Accordingly, when the limit stops 88 or 90 approach their appropriate stop means, the projecting finger 140 will abut the stop and be prevented from modulation in excess of the parameter set by the stop means 156, 158. As best seen in FIGS. 5 and 7, the ends of pin 132 project beyond the screw threads of members 138 and 138'. Thus, the members 136 and 136' cannot be adjusted past the pin 132. Accordingly, stops 156 and 158 limit movement of members 136 and 136' in one direction and pin 132 limits the movement thereof in the other direction.

In operation of the machine, rotary motion of the bed shaft 38 is converted into movement of the feed bar means 32 by the crank and linkage assemblies 50 and 52. Although the feed bar means and feed dog means carried thereby are given simultaneous vertical and horizontal movement, the magnitude of the horizontal to and fro movements is variable. That is, the disposition of the fulcrum 85 relative to the change point position defines the stitch length and/or direction of feed. In the embodiment shown, if it is desired to shorten the stitch length, at sometime during the sewing cycle, the limit assembly 88 is adjusted equal to or on one side of the change point position of fulcrum 85. In such a position, the limit assembly defines one extreme, i.e. minimum stitch length, position obtainable by the fulcrum 85. Because of their independent relationship, the other limit assembly may be adjusted at any independent linear position whereby defining the other, i.e. maximum stitch length, position obtainable by fulcrum 85. As described above, the fulcrum 85 is normally maintained in a maximum forward feed position. Thus, when a stitch shortening effect is desired, the operator may, at will, actuate the knee press whereby forcibly and rapidly displacing the fulcrum 85, by way of connecting link 106, bell crank 100, control shaft 92 and lever 98. Of course, the magnitude of displacement is limited. That is, the fulcrum 85 is allowed free movement until the abutment member 114 abuts with the limit stop 88. If, for example, the abutment member 114 is forcibly moved, under the influence of the operator, from its maximum forward feed position to a minimum forward feed position, the corresponding shifting of the fulcrum is effective to alter the output of the second motion transfer assembly so as to shorten the horizontal movement of the feed dog anywhere from a maximum forward feed to a zero forward feed whereby resulting in a stitch shortening effect.

As an alternative, the limit assembly 88 may be adjusted to the reverse side of the fulcrum's center position. Again, because of their independence, the other limit assembly may be independently adjusted to set the other extreme position for the fulcrum. Thus, when the operator desires to achieve reverse stitching, for backtacking, etc., the operator may, at will, actuate the knee press whereby forcibly and rapidly shifting the fulcrum from its forward feed position to its inversely related other on the other side of the change point position defining a reverse feed. Upon movement of the fulcrum from one side of the change point to the other, the feed will be reversed and the stitch length can be equal to or different from the stitch length in the other feed direction.

It will be appreciated that the preset position of the stitch length regulating assembly will, ultimately, determine stitch length. In the preferred embodiment, the adjustable limit 90 presets the forward stitch length of the feed assembly. That is, the regulator block 114 is urged into engagement with the preset linear position of the limit stop means 90. Through the linkages and devices described above, one extreme obtainable position for the fulcrum 85 of the second motion transfer assembly 52 is located by this limit stop. Accordingly, the stitch length in the forward direction is controlled thereby. Of course, linear displacement of the limit stop will influence the disposition of fulcrum 85 and, thus, ultimately affect the stitch length. As mentioned above, the parameters of the stitch length, in either feed direction, are determined by the position of the stops 156 and 158. The first limit stop 88 determines the other obtainable extreme position of the fulcrum defining the minimum stitch length or, in the alternative, the reverse stitch length that is obtainable at the feed dog means. It is important to note, however, there is provided but a single actuator or adjustment member for independently adjusting the forward and reverse stitch lengths.

Thus, it is apparent that there has been provided, in accordance with the invention, a feed mechanism for sewing machines that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What I claim is:

1. A stitch length regulator for a sewing machine including a housing, stitch forming instrumentalities including reciprocal needle means, a rotatable main shaft and a work feed mechanism mounted in said housing, said work feed mechanism including an elongated feed bar with feed dog means arranged at the distal end thereof, operative connections for imparting feed lift movements to the feed dog means, operative connections for simultaneously imparting horizontal movements to said feed dog means including a pitman one end of which embraces a rotary actuator on the main shaft, link means connecting said pitman and said feed bar and a fulcrumed anchor link the disposition of which controls the path of oscillation of the pitman/-linkage connection thereby controlling the stitch length of said feed dog means, said stitch length regulator comprising:

shiftable means providing the fulcrum for said anchor link;

maximum and minimum stitch length limit assemblies;

operator influenced adjustment means having but a single adjustment element capable of selectively modulating the position of either limit assembly independently of each other; and operative means for displacing said shiftable means at the will of the operator thereby influencing the disposition of said anchor link and, hence, the stitch length, said operative means having a projecting member disposed intermediate said limit assemblies and movable into an abutting relationship therewith for limiting the displacement of said anchor link within predetermined limits.

2. The invention of claim 1 wherein said maximum and minimum stitch length limit assemblies include maximum and minimum mechanical limit stops having corresponding threaded members engaged therewith, either of said members being selectively engageable with said adjustment means, but which are held from endwise movement such that movement of the adjustment means will influence the position of said limit stops thereby controlling the displacement range of said shiftable means and, hence, regulating the stitch length.

3. The invention of claim 2 wherein said adjustment means is spring biased and effective upon depression to uncouple one of said limit assemblies therefrom while simultaneously coupling the other limit assembly thereto.

4. The invention according to claim 2 wherein said adjustment means is adapted for rotation and is provided with a pin that is adapted for reception in a slot provided for in each of said threaded members.

5. The invention according to claim 2 wherein each of said limit assemblies is provided with a brake for inhibiting unwarranted turning movement of the corresponding threaded member.

6. The invention of claim 2 wherein said stitch length regulator further includes at least two motion retarding brakes arranged on opposite ends of said threaded members for interferring with the free movement thereof whereby unwarranted turning movements of the threaded members are inhibited.

7. The invention of claim 2 wherein said stitch length regulating means further includes at least two brake members adopted for functional engagement with said threaded members whereby inhibiting unwarranted turning movement of said threaded members.

8. In a sewing machine having a bed, revoluble drive shaft means having a crank portion and an improved feed mechanism including a feed bar and a feed dog carried thereby for incrementally transporting a workpiece over said bed and capable of forward and reverse feeding, said feed mechanism comprising:

first operative connections actuated by said crank portion for imparting feed lift movements to said feed dog;

second operative connections actuated by said crank portion for imparting feeding movements to said feed dog means in synchronism with the feed lift movements, said second operative connections including a pitman connected to said crank portion for deriving motion therefrom, a first link connecting the pitman and feed bar so as to impart feeding movements to said feed dog, a pivotally supported second link having an effective length equal to that of said first link for translating the motion of said pitman into movement of said first link; and regulating means for controlling the stitch length and feed direction of said feed dog, said regulating means including means for providing the pivotal support for said second link, means adapted to shift said pivotal support means at the will of the operator between two extreme positions such that the output of said second operative means and thereby the stitch length and direction may be varied depending on the position of said pivotal support means, a manually operated device having a single actuator member capable of independently influencing the position of aligned forward and reverse limit stop means both of which are responsive to said single actuator member for limiting the movement of said shiftable means whereby defining the maximum stitch length in either feed direction.

9. A sewing machine having a frame, work support means, revoluble shaft means arranged in the frame beneath the work support means, eccentric means arranged on said shaft means and a work feeding mechanism capable of forward and reverse feeding comprising:

elongated feed bar means having feed dog means arranged at the distal end thereof for movement in a generally orbital path, said feed dog means being adapted to engage and convey a workpiece over said support means;

drive mechanism means including a series of interconnected linkages operatively associated with said eccentric means and said feed bar means;

operator actuated shiftable means associated with said drive mechanism means for translating movement between said eccentric and the feed bar means and capable of selectively varying the direction and amount of workpiece movement as a function of its disposition; and feed regulating means including an aligned spaced pair of limit means provided with a singular adjustment member for independently controlling both limit means whereby controlling the degree of movement and disposition of said shiftable means and thereby the direction and amount of workpiece movement.

10. The invention according to claim 9 wherein the feed regulating means further includes means arranged independent of the adjustment member for confining the movement of said limit means within predetermined limits.

11. A sewing machine having a work support bed, a drive shaft with a rotary actuator thereon and a feed mechanism comprising:

elongated feed bar means with feed dog means carried at the distal end thereof;

a rocker having an arm pivotally connected to the other end of said feed bar means;

a pitman adapted to be driven by said rotary actuator;

link means connecting said pitman to the feed bar means;

a fulcrumed anchor link for coordinating the movement of said pitman and said link means whereby to and fro movements are imparted to said feed dog means;

operator controlled means for selectively shifting the fulcrumed position of said anchor link between two positions defining maximum and minimum stitch length; and adjustment means having a single actuator capable of independently setting the minimum and maximum limits obtainable by said operator controlled means whereby effecting the range of movements of the feed dog.

12. A sewing machine having a frame, a rotary actuator mounted in said frame and an improved feed mechanism capable of developing forward and reverse feed movements comprising:

a feed bar having a feed dog carried thereby;

operative connections between said rotary actuator and said feed bar for moving the feed dog in an oribtal path;

operative means mounted within said housing for selective positioning between forward and reverse feed positions, said operative means controlling the motion of said operative connections and thereby the direction and amount of feed dog movement;

a regulating assembly for limiting the movement of said operative means between its forward and reverse positions, said regulating assembly includes forward and reverse limit stops, a single actuator engageable with either of said stop means for independently adjusting the position thereof, linkage means connected to said operative means and shiftable at the will of the operator to change the feed amount and direction of the feed dog, and means carried by said linkages and arranged for disposition between said stop means for limiting the movement of the operative means.

13. A sewing machine according to claim 12 wherein said regulating assembly further includes a spring means that engages said linkage means and normally biases said operative means into a forward feed position.

14. A sewing machine having a frame, a rotary actuator mounted in said frame and an improved feed mechanism capable of incrementally advancing a workpiece at various stitch lengths during the machine's sewing cycle comprising:

a feed bar having a feed dog carried thereby;

first motion transmitting mechanism operably connecting said rotary actuator with said feed bar to convert the rotary motion of said rotary actuator into vertical motion of the feed dog;

second motion transmitting mechanism operably connecting said rotary actuator with said feed bar to convert the rotary motion of said actuator into horizontal movement of the feed dog;

operative means mounted within said housing for selective positioning between two extremes defining maximum and minimum feed amounts, said operative means controlling the output of the second motion transmitting mechanism and thereby regulating the magnitude of horizontal feed dog movement;

a regulating assembly for setting limits on the movements of said operative means thereby controlling the parameters of feed dog movement, said regulating assembly includes a single actuator means, first and second spaced limit stops independently engagable with said means and arranged for linear adjustment relative to each other, a series of shiftable linkages connected to said operative means for changing the feed amount and means carried by said linkages and disposed between said stop means for limiting the movement of the operative means.

15. The invention according to claim 14 wherein said regulating assembly further includes a spring means adapted to engage and bias said operative means into a position defining an extreme feed setting.

16. A sewing machine having a frame, a drive shaft revolubly mounted in said frame and having a crank portion arranged thereon and an improved feed mechanism capable of developing maximum and minimum feed movements comprising:

a feed bar having a feed dog means adapted for orbital movement;

operative connections between said drive shaft crank portion and said feed bar for moving said feed dog means in an orbital path;

operative means associated with said operative connections and effectively arranged intermediate said drive shaft crank portion and said feed bar for changing the operative effect of said drive shaft crank portion; and feed regulatory means operatively associated with said operative means including an operator influenced adjustment member having both maximum and minimum feed limit means coaxially arranged thereon and adjustably responsive to said adjustment member for selectively and independently regulating the obtainable maximum and minimum feed movements.

17. Stitch length adjusting means for sewing machines having a frame, an actuating mechanism comprising a revoluble shaft having a rotary actuator arranged thereon, a work feeding mechanism effective to transport a workpiece relative to said sewing machine frame in either forward or reverse directions, means driven by said rotary actuator for operating said work feeding mechanism, said stitch length adjusting means comprising:

a regulating member shiftably supported in said frame and associated with said operating means to control the stitch length and direction of said work feeding mechanism;

a control shaft rotatably mounted in said frame and having said regulating member carried thereby;

operator controlled means connected to said control shaft for selectively turning said shaft a controlled amount whereby moving said regulating member and, hence, changing the stitch length or direction of movement of the work feeding mechanism;

axially aligned forward and reverse limit means;

a spring biased operator influenced control rod selectively engageable with either of said limit means for independently setting the stitch length in either feed direction; and linkage means for connecting said operator controlled means with said control shaft including means disposed between said limit means and movable with said operator controlled means into an abutting relationship with said limit means for limiting the movement of said control shaft whereby regulating the stitch length in either feed direction.

18. The invention according to claim 17 wherein said stitch length adjusting means further includes a bell crank lever carried by and movable with said control shaft, the first arm of said lever being operatively connected to said operator controlled means and the other end being provided with indicia for denoting the present stitch length and direction of said work feeding mechanism.

19. In a sewing machine having a frame, stitch forming instrumentalities including a reciprocal needle means mounted in said frame and an improved feed mechanism including feed dog means capable of forward and reverse feeding directions, said feed mechanism comprising:

oscillatory means operatively connected to a shiftable anchor link for moving said feed dog means in an orbital path and in timed relation to the needle reciprocation;

a control shaft rotatably mounted in said frame for setting the disposition of said anchor link thereby governing the stitch length and direction of said feed dog;

operator controlled means in operative engagement with the control shaft for selectively turning said shaft a controlled amount whereby shifting the anchor link and thereby changing the stitch length or direction of said feed dog;

means operative to control the stitch length of said feed dog means in either feed direction, said means operative including a first limit stop means for limiting the movement of said anchor link in one direction, a second limit stop means for limiting the movement of said anchor link in the other direction, a control element capable of adjusting either of said stop means independently of each other, and means for normally biasing said anchor link into a position such that a forward feed direction is produced by said feed dog means at a preselected stitch length.

20. In a sewing machine having a frame, work support means, needle means mounted for reciprocation in said frame and movable through a material workpiece so as to form stitches therein, drive shaft means having a rotary actuator arranged thereon and a material feeder mechanism mounted in said frame beneath said work support means including a material engaging gripper member, said material feeder mechanism comprising:

first linkage assembly means operatively connected to said rotary actuator for imparting vertical lift movements to said gripper member;

second linkage assembly means arranged independently of said first linkage assembly means and actuated by said rotary actuator for simultaneously imparting horizontal movements to said gripper member, said last mentioned means including a pivotal swinging member, the fulcrumed position of which determines the magnitude of horizontal movement imparted to said gripper member; and adjusting means including means providing a movable fulcrum for said pivotal swinging member for operationally limiting the movement of the gripper member away from the needle as a function of the position of said movable fulcrum means, said adjusting means including an abutment member responsive to the movement of said fulcrum, a pair of stop members extending into the path of said abutment member, and a single actuator element supporting said stop members each on opposite sides of said abutment member and for selective independent adjustment toward or away from each other.

21. A sewing machine having a work supporting bed, a rotary actuator carried by a drive shaft and a feed mechanism comprising:

elongated feed bar means with feed dog means carried at the distal end thereof;

a pitman one end of which embraces said rotary actuator;

link means connecting the other end of said pitman to said feed bar means;

a fulcrumed anchor link for coordinating the movement of said pitman and said link means whereby to and fro movements are imparted to said feed dog means, wherein said fulcrumed anchor link is connected to a stitch length regulating assembly having upper and lower limit stops for adjusting the feed mechanism between maximum and zero stitch lengths upon pivotal displacement of the anchor link fulcrum; and said stitch length regulating assembly includes a first stitch length limit means having a pair of interengaging control elements, a second stitch length limit means having a pair of interengaging control elements, said first and second stitch length limit means being telescopically arranged on a single operator influenced control member capable of selectively and independently setting the position of each limit means and fulcrumed linkage assembly connected to the anchor link and adapted to be shifted at the will of the operator so as to change the amount of feed, said linkage assembly being provided with a projecting member that is confined for movement between said first and second stitch length limit means whereby the feed amount is controlled within predetermined limits.

22. A stitch length regulator for a sewing machine including a housing, stitch forming instrumentalities including reciprocal needle means, a rotatable main shaft and a work feed mechanism mounted in said housing, said work feed mechanism including an elongated feed bar with feed dog means arranged at the distal end thereof, operative connections for imparting feed lift movements to the feed dog means, operative connections for simultaneously imparting horizontal movements to said feed dog means including a pitman one end of which embraces a rotary actuator on the main shaft, link means connected to said pitman and said feed bar and an anchor link the fulcrumed disposition of which controls the path of oscillation of the pitman/link connection thereby controlling the feed amount and direction of said feed dog means, said stitch length regulator comprising:

means shiftable between generally inversely related positions defining forward and reverse feed directions and for providing the fulcrum for said anchor link;

forward and reverse spaced limit stop assemblies having a conjointly arranged adjustment member effective to independently set the positions of said limit stop assemblies; and operative means effective to displace said shiftable means at the will of the operator thereby influencing the disposition of said anchor link;

the movement of said operative means being controlled by the set positions of said limit stop assemblies whereby limiting the displacement of said anchor link within predetermined limits.

23. The invention of claim 22 wherein said limit stop assemblies include one pair of interengageable element means including a limit stop element that is threadably engaged with a screw element, the latter being coaxially arranged on said adjustment member and prevented from endwise displacement such that selective turning of said adjustment member will vary the linear position of either of said limit stops thus modulating the maximum obtainable feed amount in either direction.

24. The invention according to claim 23 wherein said stitch length regulator includes a guide means providing a guideway, said limit stop element having a projecting finger embraced by said guideway so as to allow shifting of said limit stop endwise to said screw element.

25. The invention according to claim 24 wherein said stitch length regulator further includes a means effectively associated with said guide means for preventing the displacement of said limit stop element beyond a predetermined position.

26. A sewing machine having a frame, a drive shaft revolubly mounted in said frame and having an eccentric arranged thereon and an improved feed mechanism capable of developing forward and reverse feed movements comprising:

a feed bar having a feed dog adapted for orbital movement;

operative connections between said eccentric and said feed bar for moving said feed dog means in an orbital path;

operative means associated with said operative connections and effectively arranged intermediate said eccentric and said feed bar for varying the feed advance movement from zero to maximum upon movement of said operative means away from a center position and for reversing the feed advance movement upon movement of said operative means in opposite directions from said center position;

adjusting means for selectively and independently limiting the magnitude of feed dog movement in either direction of movement, said adjusting means including an abutment member movable with said operative means, a pair of stop members extending into the path of said abutment member, and a control rod independently supporting said stop members each on opposite sides of said abutment member and for selective independent adjustment relative one another.

27. The invention of claim 26 wherein said rod is mounted for turning and endwise movement and having said stop members constrained from rotation with said rod but slidably axially thereof upon engagement and turning of said rod.

* * * * *